United States Patent [19]

Wu et al.

[11] Patent Number: 4,975,606

[45] Date of Patent: Dec. 4, 1990

[54] PROJECTILE LAUNCH PACKAGE FOR ARC DRIVEN ELECTROMAGNETIC LAUNCHERS

[75] Inventors: Jiing-Liang Wu, Murrysville; Douglas A. Fikse, Pittsburgh, both of Pa.

[73] Assignee: Westinghouse Electric Corp., Pittsburgh, Pa.

[21] Appl. No.: 452,265

[22] Filed: Dec. 22, 1982

[51] Int. Cl.[5] ..... H02K 41/00; F41F 1/00

[52] U.S. Cl. ..... 310/12; 310/13; 89/8; 318/135

[58] Field of Search ..... 124/3; 318/135; 310/12–19; 89/8; 102/202.7

[56] References Cited

U.S. PATENT DOCUMENTS 3,763,740 10/1973 Teng ..... 89/8

4,347,463 8/1982 Kemeny et al. ..... 310/13 X

FOREIGN PATENT DOCUMENTS 2123934 2/1984 United Kingdom .

OTHER PUBLICATIONS

Study of an Electromagnetic Gun for Air Defense, Air Force Armament Lab, McNab & Deir (Westinghouse), 11/81, 5 pages.

*Primary Examiner*—Mark O. Budd

*Attorney, Agent, or Firm*—R. P. Lenart

[57] ABSTRACT

A projectile launch package for use in electromagnetic launching systems is provided with separable armature and projectile assemblies. The armature assembly includes a conductive element which initially conducts accelerating current. After a certain time, the conductive element fuses, thereby forming a plasma which further accelerates the projectile assembly. Following the plasma initiation, the armature assembly is expelled from the launcher under its own momentum.

4 Claims, 1 Drawing Sheet

PROJECTILE LAUNCH PACKAGE FOR ARC DRIVEN ELECTROMAGNETIC LAUNCHERS

BACKGROUND OF THE INVENTION

This invention relates to electromagnetic projectile launching systems and more particularly to launch packages for such systems which include a conductive armature for initial acceleration and a plasma armature for additional acceleration.

Electromagnetic projectile launchers are known which comprise a pair of conductive rails, a sliding conductive armature between the rails, a source of high current and a switch for commutating this current into the rails and through the armature. Current flow through the rails and armature results in an electromagnetic force on the armature which propels it along the conductive rails. Launchers which utilize a sliding metallic armature have experienced considerable rail damage caused by failure of the sliding armature in the breech region. Metallic armatures are also limited by resistive heating and their ability to respond to rail unevenness at high velocities. In these cases, a plasma or arc armature may be more suitable.

The principal disadvantage to the use of a plasma propelling armature has been the damage that occurs to the breech section of the launcher rails during formation of the plasma. Once the plasma is moving at substantially high speed, very little, if any, rail damage occurs. U.S. Pat. No. 4,347,463, issued Aug. 31, 1982 to Kemeny and Litz, discloses a means for establishing an arc for propelling a projectile comprising a shooting wire or fuse which initiates current flow between the rails, disintegrates, and thereby forms a plasma or arc through which current continues to flow. After the fuse explodes, the plasma exerts a force on the projectile and accelerates it to a high velocity, while debris from the fuse explosion is left behind in the barrel breech section. Because the mass ratio between a projectile and a plasma armature is greater than that between a projectile and a sliding metallic armature, more efficient utilization of a given available launch package energy is possible with plasma drive. In addition, plasma drive provides a means for launching ultra high velocity projectiles. Therefore the application of plasma driven projectiles in multi-shot systems is appropriate.

Several methods have been suggested for initiating an arc or plasma in electromagnetic launcher systems. These procedures are primarily directed to resolving the problem of creating the plasma armature and minimizing the resulting thermal and mechanical damage of the launcher rails. Ablation of the rail surfaces is caused by a slow moving or stationary arc and occurs during initial acceleration of the projectile from zero velocity. At higher projectile velocities, the effect of this thermal phenomenon becomes increasingly insignificant. Therefore a means for imparting initial momentum to the launch package is desired to prolong launcher rail life. Copending commonly assigned application entitled "Electromagnetic Projectile Launcher With Explosive Start and Plasma Drive", Ser. No. 399,509, filed July 19, 1982 by Ross, discloses an electromagnetic launcher which utilizes an exploding fuse in an air tight insulating cartridge to generate a plasma with sufficient pressure to impart starting momentum to a projectile thereby increasing initial arc velocity.

Excessive launcher rail damage has been observed where a copper fuse is blown to form a plasma composed mainly of copper ions. This resulted in sputtered metal from a partially vaporized fuse and thermal erosion of the rail surfaces from a slow moving or stationary arc over only a short length of rail starting at the original location of the fuse in the breech. Therefore the design of a fuse and an interface between the fuse and a projectile must consider the usual design criteria of desired fuse explosion time and peak voltage after fuse explosion, as well as other factors which include: reducing the explosive damage to the launcher barrel and projectile; minimizing the time that the fuse mass must be accelerated; and handling the fuse debris so that dielectric problems are eliminated. A launch package constructed in accordance with the present invention addresses these factors and provides for the additional benefit of reduced barrel rail damage during the initial stage of plasma acceleration.

SUMMARY OF THE INVENTION

A projectile launch package for electromagnetic projectile launching systems constructed in accordance with this invention, comprises: a projectile assembly, including a bore sealing insulating sabot structure; and an armature assembly disposed adjacent to but separable from the projectile assembly, wherein the armature assembly includes a fusible conductive element and means for restraining the fusible conductive element. The means for restraining the fusible conductive element includes an opening leading from the fusible conductive element to the projectile assembly bore sealing sabot structure. During a launch, initial accelerating current is conducted between a pair of projectile launching rails through the fusible conductive element. This current flow produces an electromagnetic force on the projectile launch package which accelerates it to an initial predetermined velocity. Then the conductive element fuses, thereby creating a plasma which passes through the opening in the restraining means and serves to conduct current between the launcher rails for further acceleration of the projectile assembly. The armature assembly, which no longer carries current, continues to travel through the launcher bore because of its initial momentum. The restraining means minimizes scattering of the exploded fuse debris, thereby minimizing dielectric problems.

DESCRIPTION OF THE PREFERRED EMBODIMENT

Figure 1:
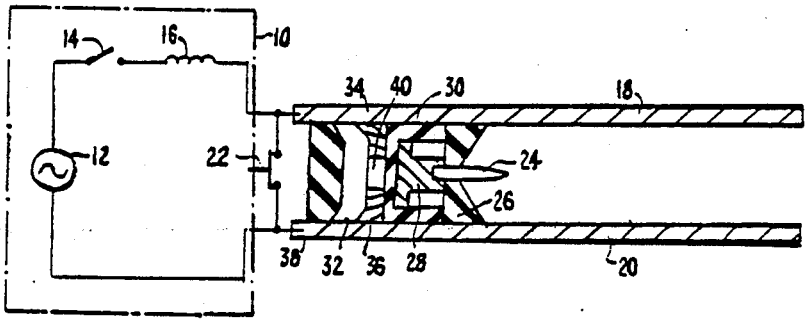
FIG. 1 is a schematic diagram of an electromagnetic projectile launching system including a projectile launch package constructed in accordance with one embodiment of this invention.

Referring to the drawings, FIG. 1 is a schematic diagram of an electromagnetic projectile launching system including a launch package constructed in accordance with one embodiment of this invention. A source of high current 10 comprising the series connection of generator 12, switch 14 and inductive energy storage means 16 is connected to a pair of generally parallel conductive projectile launching rails 18 and 20 which line the launcher bore. A firing switch 22 is connected between the breech ends of launching rails 18 and 20. The projectile launch package contains two adjacent but separable assemblies: the projectile assembly and the fuse or armature assembly.

The projectile assembly comprises a projectile 24, a projectile support 26 having a central aperture for receiving projectile 24, a pusher plate 28 having cavity for receiving projectile 24, and a bore sealing insulating sabot structure having a cavity for receiving pusher plate 28. The fuse, or armature, assembly comprises a plurality of thin conductive elements or contact plates 32 sandwiched between two metallic cover plates 34 and 36, and an insulating fuse spacer 38. Conductive elements 32 are designed to fuse once the projectile launch package has achieved an initial predetermined velocity, thereby forming a plasma which passes through opening 40 to further accelerate the projectile assembly.

Figure 2:
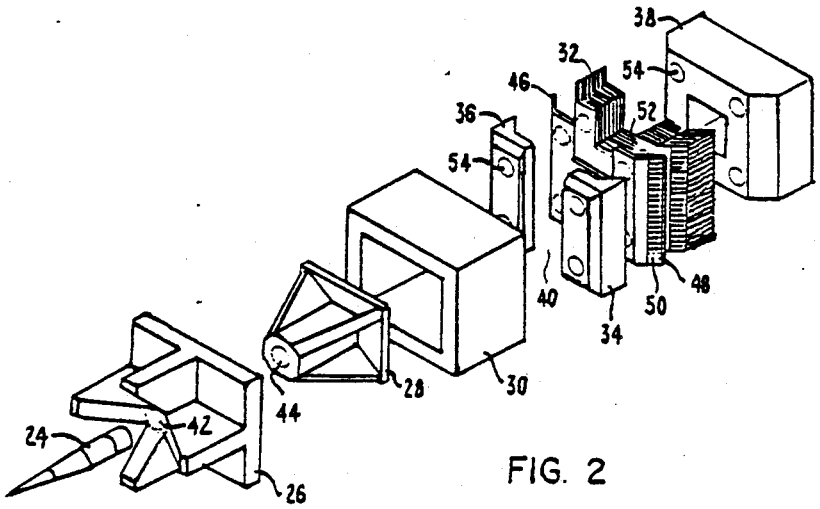
FIG. 2 is an exploded view of the projectile launch package of FIG. 1.

FIG. 2 is an exploded view of the projectile launch package of FIG. 1. When the launch package is assembled, projectile 24 passes through opening 42 in projectile support 26 and further passes into cavity 44 in pusher plate 28. Pusher plate 28 is detachably inserted into bore sealing insulating sabot structure 30. In this embodiment, both the projectile support and the bore sealing insulating sabot structure are constructed of insulating plastic such as polycarbonate. The pusher plate 28 is machined from a light weight high strength material such as titanium. Insulating sabot structure 30 must be sized to provide for a close fit between the sabot and the launcher bore. In addition to functioning as a guide for the launch package, the sabot structure also acts as a means for sealing the high pressure plasma which accelerates the projectile assembly during a launch. Except for the sabot structure, close tolerance machining is not required for the other projectile assembly components.

The fuse assembly is shown to include a plurality of conductive elements 32 which are stacked together and sandwiched between metallic cover plates 34 and 36 and insulating base 38. Each conductive element or contact plate 32 is generally chevron shaped and includes two contact surfaces 46 and 48. A plurality of slots 50 are cut into each contact surface to improve electrical contact between the contact surfaces and the projectile launching rails. The contact plates 32 further include a section 52 of reduced cross-sectional area which fuses after the launch package has reached a predetermined velocity. When section 52 fuses, a plasma is created which passes through opening 40 between cover plates 34 and 36 and serves as a means for conducting current between the launcher rails to further accelerate the projectile assembly. The number of contact plates 32 and cross-sectional area of section 52 can be selected to achieve a preselected fuse explosion time. Zirconium copper is the preferred material for the contact plates, while aluminum is used for cover plates 34 and 36, and polycarbonate is used for fuse base 38. A plurality of holes 54 are included in the cover plates, contact plates and fuse base to accept a plurality of bolts, not shown, which hold the fuse assembly together.

The launch sequence of an electromagnetic launching system which includes a launch package constructed in accordance with this invention, can be described with reference to FIG. 1. Prior to the launch, the launch package is placed within the breech of the projectile launcher bore, with the armature assembly being adjacent to and separable from the projectile assembly. Switches 14 and 22 are initially closed to allow generator 12 to charge inductive energy storage means 16 to a predetermined firing current. When this predetermined firing current has been achieved, firing switch 22 is opened, thereby commutating the firing current into launcher rails 18 and 20. As current starts to flow from launcher rail 18 through contact plates 32 and into launcher rail 20, the fuse and projectile assemblies are accelerated together. After the current has flowed for a predetermined time, the section of reduced cross-sectional area of each contact plate melts and explodes, thereby generating a plasma. The plasma, which is subjected to an electromagnetic force, subsequently passes through opening 40 and exerts pressure on the back surface of insulating sabot structure 30 to accelerate the projectile assembly to a high speed. The fuse assembly, which no longer carries current, travels with its initial momentum. Cover plates 34 and 36, in combination with fuse base 38 minimize scattering of the exploded fuse debris and thereby minimize dielectric problems.

Since the fuse explosion is initiated in the central region of the launcher bore and away from the launcher rails, damage to the launcher rails is minimized. Because the projectile gains initial speed prior to the fuse explosion and the fuse and projectile assemblies separate after the fuse explosion, high rates of acceleration of the projectile assembly can be projected. It is known that stationary or slow moving plasmas cause significant damage to copper projectile launching rails. By controlling the fuse explosion time, a desirable initial speed of the plasma can be obtained, thereby minimizing rail damage.

Although the present invention has been described in terms of what is at present believed to be the preferred embodiment, it will be apparent to those skilled in the art that various changes or modifications may be made to the launch package structure without departing from this invention. Such changes include making the periphery of the launch package elements round so that they can be used in a cylindrical bore launcher. It is therefore intended that the appended claims cover all such changes and modifications which occur within the scope of this invention.

What is claimed is:

1. A projectile launch package for an electromagnetic projectile launcher comprising:

a projectile assembly, including a bore-sealing insulating sabot structure;

an armature assembly disposed adjacent to but separable from said projectile assembly wherein said armature assembly includes a fusible conductive element and means for restraining said fusible conductive element with said means for restraining having an open leading from said fusible conductive element to said projectile assembly, such that an arc formed when said conductive element fuses, following an initial acceleration of said launch package, passes through said opening to further accelerate said projectile assembly;

wherein said fusible conductive element includes a plurality of contact plates, each having a section of reduced cross-sectional area such that current flowing through said contact plates will cause said sections of reduced crosssectional area to fuse after said conductive elements reach a predetermined velocity; and wherein said means for restraining said conductive element includes an insulating base disposed on one side of said conductive element; a pair of cover plates disposed on the other side of said conductive element wherein said opening leading from said conductive element to said projectile assembly passes between said cover plates; and means for holding said insulating base, said cover plates and said conductive element together.

2. A projectile launch package as recited in claim 1 wherein said projectile assembly comprises:

a projectile, detachably held with respect to said sabot structure.

3. A projectile launch package as recited in claim 2, wherein said projectile assembly further comprises:

a pusher plate disposed behind said projectile.

4. A projectile launch package as recited in claim 2, wherein said projectile assembly further comprises:

a projectile support plate having a cavity into which said projectile extends.

* * * * *